US005569017A

United States Patent [19]

Barnhart et al.

[11] Patent Number: 5,569,017

[45] Date of Patent: Oct. 29, 1996

[54] FAN END BRACKET FOR HIGH VELOCITY LOW PRESSURE BLOWERS

[75] Inventors: Gary A. Barnhart, Newbury; David P. Gill, Canton, both of Ohio

[73] Assignee: Ametek, Inc., Kent, Ohio

[21] Appl. No.: 361,683

[22] Filed: Dec. 22, 1994

[51] Int. Cl.[6] ..... F04D 29/58; F04D 29/62

[52] U.S. Cl. ..... 415/177; 415/206; 415/212.1; 417/360

[58] Field of Search ..... 415/177, 206, 415/207, 212.1; 417/360

[56] References Cited

U.S. PATENT DOCUMENTS

| | | | |
|---|---|---|---|
| 2,509,555 | 5/1950 | Youhouse | 415/206 |
| 2,844,100 | 7/1958 | Heinicke | 415/215.1 |
| 3,301,472 | 1/1967 | Dixon et al. | 415/206 |
| 4,884,946 | 12/1989 | Belanger et al. | 415/206 |
| 5,040,943 | 8/1991 | Dwyer et al. | 415/206 |
| 5,069,599 | 12/1991 | Carretta | 415/207 |

*Primary Examiner*—Edward K. Look
*Assistant Examiner*—Michael S. Lee
*Attorney, Agent, or Firm*—Renner, Kenner, Greive, Bobak, Taylor & Weber

[57] ABSTRACT

An improved end bracket is provided for a high velocity low pressure blower assembly. The end bracket includes a pair of members, each heat sink having several vanes. The bracket further includes a bearing boss having heat dissipating vanes radiating from it. The heat sink members and vanes serve to dissipate heat from a bearing which is mounted in the bearing boss. The bracket also includes a tangential exhaust horn having a threaded hose coupling. The exhaust horn communicates with a tapered scroll passage which serves to direct air to the exhaust horn. The scroll passage is tapered to allow the high velocity air to expand as it becomes hotter, thereby reducing turbulence at the exhaust.

8 Claims, 5 Drawing Sheets

FAN END BRACKET FOR HIGH VELOCITY LOW PRESSURE BLOWERS

TECHNICAL FIELD

The invention herein resides in the art of air moving blower devices. More particularly, the invention relates to high velocity low pressure blowers. Specifically, the invention relates to the fan end bracket for such blowers.

BACKGROUND ART

Heretofore, it has been known that high velocity low pressure (HVLP) blower systems are well suited for use in applications demanding rapid delivery of large volumes of working air such as portable paint sprayers and the like. Such HVLP systems are capable of handling the required air volume without the need to develop high pressures. Accordingly, such systems do not require large elaborate and expensive air compressor units. Typically, HVLP blower assemblies employ multistage fan units comprising various combinations of rotating and stationary fan members. The fan members are housed in an enclosure having a working air intake. The enclosure is closed by an end bracket which comprises a flat plate member having a bearing boss and an exhaust tube therein. A conventional pre-lubricated sealed or shielded ball bearing is mounted in the boss. A motor is bolted to the end bracket, the motor shaft is journaled in the bearing and is operatively connected to the rotating fan members.

Such systems are designed to develop air velocities which are highest at the exhaust. Air moving at such high velocity tends to undergo a rather dramatic increase in temperature. This increase in temperature produces several undesirable results. The heated air expands resulting in increased pressure and a great deal of turbulence at the exhaust, and as such the efficient movement of air is hindered. The high velocity air also causes the end bracket to become quite hot, the heated end bracket transfers heat to the bearing and also to the motor. Increased bearing temperature results in a change in lubricant viscosity, thereby affecting lubricant performance. Frequently, the lubricant is driven out of the bearing around the seals or shields due to the heat and pressure differential from one side of the bracket to the other.

Previously known end brackets typically have a working air exhaust comprised of a straight tubular member. Accordingly, it is necessary to provide additional means to establish a connection between the end bracket and the working air passage or hose. Typically, this is accomplished by the use of an adhesive set screw clamp or weld to mount an appropriate coupling to the exhaust tube. Accordingly, it is desired to obtain an end bracket for a HVLP blower which promotes efficient movement of expanding air, alleviates bearing and lubricant problems associated with heat, and allows for facile connection of hose fittings.

DISCLOSURE OF INVENTION

In light of the foregoing, it is an aspect of the invention to provide an end bracket which promotes the efficient movement of expanding air.

Another aspect of the invention is the provision of an end bracket which alleviates bearing and lubrication problems by dissipating heat at the bracket.

Yet an additional aspect of the invention is the provision of an end bracket which allows facile connection of hose fittings.

A further aspect of the invention is the provision of an end bracket which is reliable, durable, and easy to implement with state of the art apparatus and techniques.

The foregoing and other aspects of the invention which will become apparent as the detailed description proceeds are achieved by an improved high velocity, low pressure blower assembly having a working air hose, a fan assembly enclosed in a fan housing, the fan housing having an air intake, a motor mounted on the fan housing and journaled in a bearing, and the fan assembly being drivingly connected to the motor, the improvement comprising: an end bracket mounted on the fan housing; means for dissipating heat incorporated in said end bracket; means for exhausting air from the fan housing, said means for exhausting incorporated in said end bracket; means for directing air from the fan assembly to said means for exhausting, said means for directing incorporated in said end bracket; means for reducing air turbulence in said means for directing, said means for reducing incorporated in said means for directing; and means for connecting said means for exhausting to the working air hose, said means for connecting incorporated in said means for exhausting.

Other aspects of the invention are attained by a fan end bracket for a high velocity, low pressure blower system, said fan end bracket comprising: an annular main body plate; a circumferential wall surrounding said main body plate; a tapered scroll passage in said main body plate; a tangential exhaust horn extending outwardly from said main body plate, said exhaust horn communicating with said tapered scroll passage; a threaded coupling portion on said exhaust horn; at least one heat sink member extending from said main body plate; a plurality of vanes extending outwardly from said at least one heat sink member; at least one motor mounting standoff extending from said main body plate; a bearing boss extending from said main body plate; and a plurality of vanes radiating outwardly from said bearing boss.

Still other aspects of the invention are attained by a high velocity, low pressure blower assembly comprising: a fan housing having an air intake aperture; at least one fan member mounted in said fan housing; an end bracket mounted on said fan housing, said end bracket comprising a main body plate having an inner surface and an outer surface, a circumferential wall surrounding said main body plate, a plurality of fastener lugs extending outwardly from said circumferential wall, a tapered air passage in said inner surface of said main body plate, an exhaust horn extending outwardly from said main body plate and communicating with said tapered air passage, a threaded coupling boss on said exhaust horn, at least one heat sink member extending outwardly frown said outer surface of said main body plate, a plurality of vanes extending outwardly from said at least one heat sink member, at least one motor mounting standoff extending outwardly from said outer surface of said main body plate; at least one fastener boss in said at least one motor mounting standoff, a bearing boss extending outwardly from said outer surface of said main body plate, said bearing boss comprising a circumferential wall, a plurality of vanes radiating from said circumferential wall, and a shaft aperture; a bearing mounted in said bearing boss, said bearing having an inner bore and a circumferential outer wall; and a motor mounted on said at least one motor mounting standoff, said motor having a shaft received in said inner bore of said bearing and also received in said shaft aperture of said bearing boss and operatively connected to said at least one fan member.

BRIEF DESCRIPTION OF DRAWINGS

For a complete understanding of the objects, techniques and structures of the invention reference should be made to the following detailed description and accompanying drawings wherein.

BEST MODE FOR CARRYING OUT THE INVENTION

Figure 1:
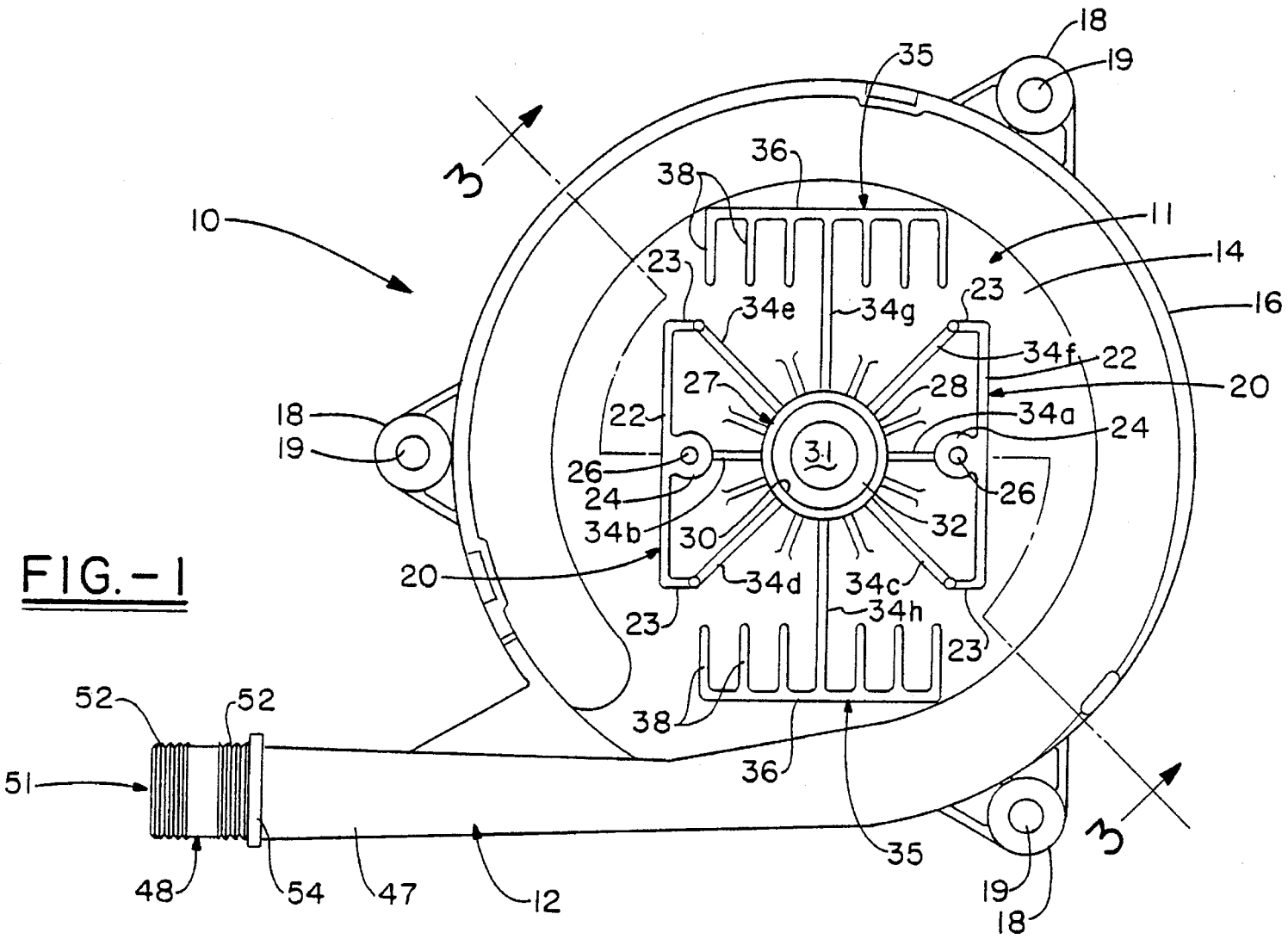
FIG. 1 is a top plan view of an end bracket according to the concept of the present invention.
Figure 2:
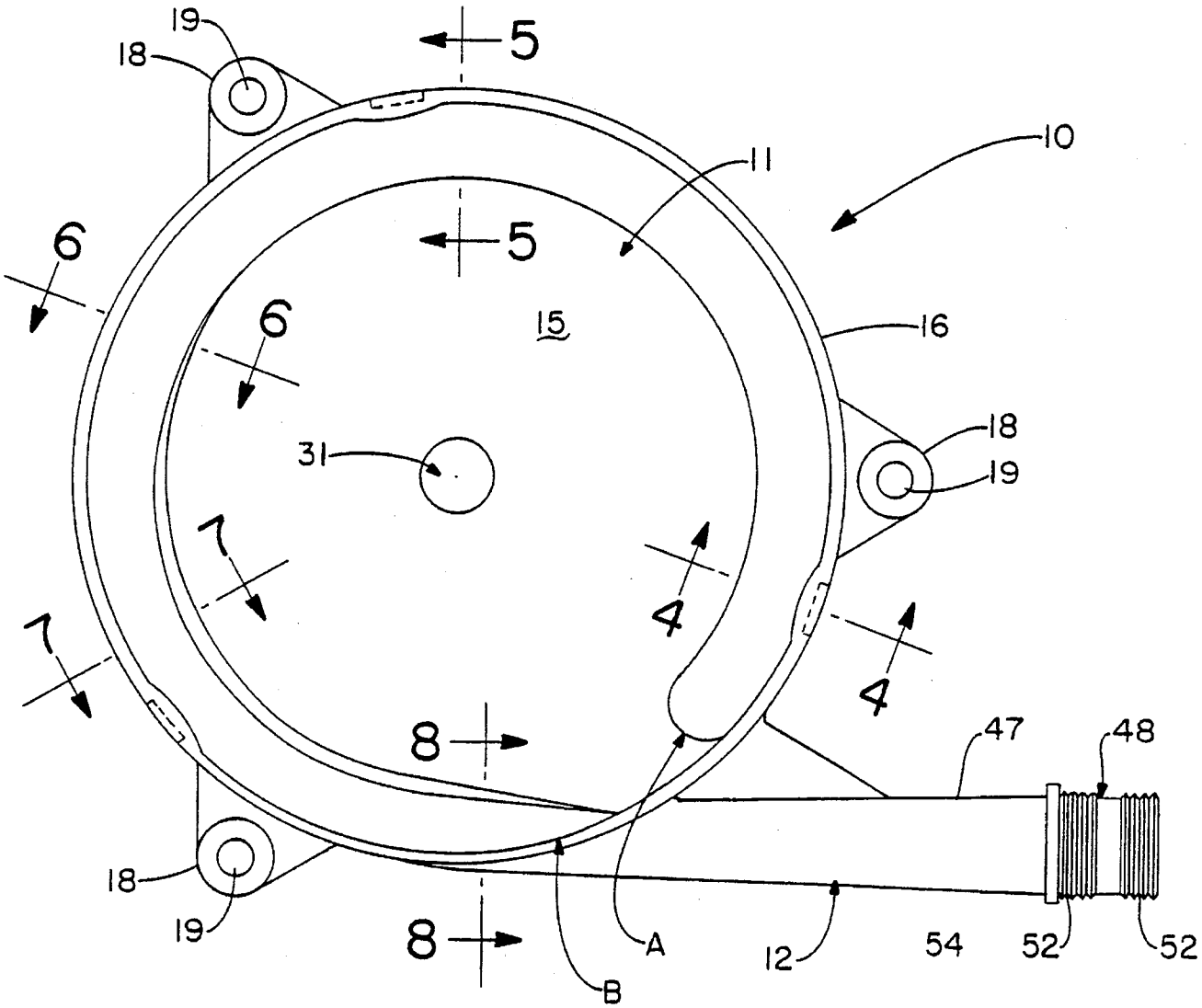
FIG. 2 is a bottom plan view of the novel end bracket.
Figure 5:
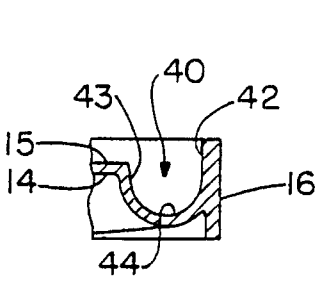
FIG. 5 is a partial cross-sectional view of the bracket of FIG. 2 taken along the line 5—5.
Figure 7:
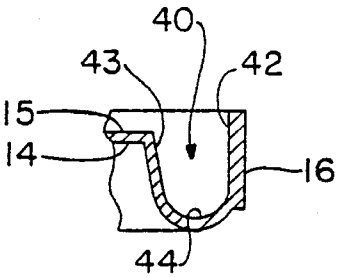
FIG. 7 is a partial cross-sectional view of the bracket of FIG. 2 taken along the line 7—7.
Figure 4:
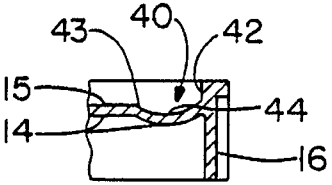
FIG. 4 is a partial cross-sectional view of the bracket of FIG. 2 taken along the line 4—4.
Figure 6:
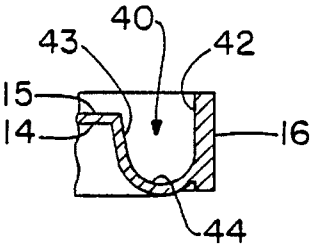
FIG. 6 is a partial cross-sectional view of the bracket of FIG. 2 taken along the line 6—6.

Referring now to the drawings, it can be seen that a fan end bracket according to the invention is designated generally by the numeral 10. While it will be appreciated that the concept of the invention is applicable to many variations in blower assemblies, the description herein will be with respect to an end bracket for use with a blower assembly of the nature shown. In such a device, the end bracket 10 is comprised generally of a main body plate 11 and an exhaust horn 12. With reference particularly to FIGS. 1 and 2, it can be seen that the plate 11 has an upper surface 14, and a lower surface 15. The generally annular plate member 11 is surrounded about its periphery by a vertical side wall 16. A plurality, preferably three, of fasteners lugs 18 extend outwardly from the wall 16 at equally spaced intervals around the circumference thereof, each lug 18 including a fastener aperture 19 therein.

As shown in FIG. 1, a pair of opposed motor mounting brackets 20 extend upwardly from the upper surface 14 of the plate 11. In the preferred embodiment each mounting bracket 20 is comprised of a support wall 22 and a pair of legs 23. The legs 23 are contiguous with the wall 22, are each disposed at a right angle to the wall 22 at the ends thereof, and are directed toward the opposite bracket 20. At a central point along the length of the wall 22 of each bracket 20 is a fastener boss or motor mounting standoff 24. Each fastener boss 24 is a generally cylindrical member and includes a fastener aperture 26 therein.

A bearing boss 27 is provided on the plate 11 and is located at the center thereof between the mounting brackets 20. As can be seen the bearing boss 27 is comprised of a circumferential side wall 28 which forms a bearing receiving bore 30. A motor shaft aperture 31 is provided in the plate 11 inside the bearing receiving bore 30. The aperture 31 is concentric with the wall 28 and as such forms a bearing seat 32 therein. A plurality of vanes 34 radiate outwardly from the wall 28. As shown, the pair of vanes 34*a* and 34*b* communicate with the fastener bosses 24, while four of the vanes 34*c*, 34*d*, 34*e*, and 34*f* each communicate with a leg 23 of the mounting brackets 20. Similarly, a pair of vanes 34*g* and 34*h* extend outwardly to communicate with the heat sink members to be described. The remaining vanes 34 are spaced at equal intervals around the periphery of the bearing boss 27.

It will further be noted that a pair of opposed heat sink members 35 also extend upwardly from the upper surface 14 of the plate 11. As shown each heat sink member 35 includes a main wall 36 with a plurality of vanes 38 extending orthogonally from the wall 35, and spaced at equal intervals along the length thereof. It will be apparent from the drawings that the heat sink members 35 are oriented such that the main walls 36 are substantially perpendicular to the support walls 22 of the motor mounting brackets 20. Further, the vanes 38 of each of the opposed heat sink members 35 are directed toward the vanes 38 of the other heat sink member 35 and thus toward the center of the plate 11.

Figure 3:
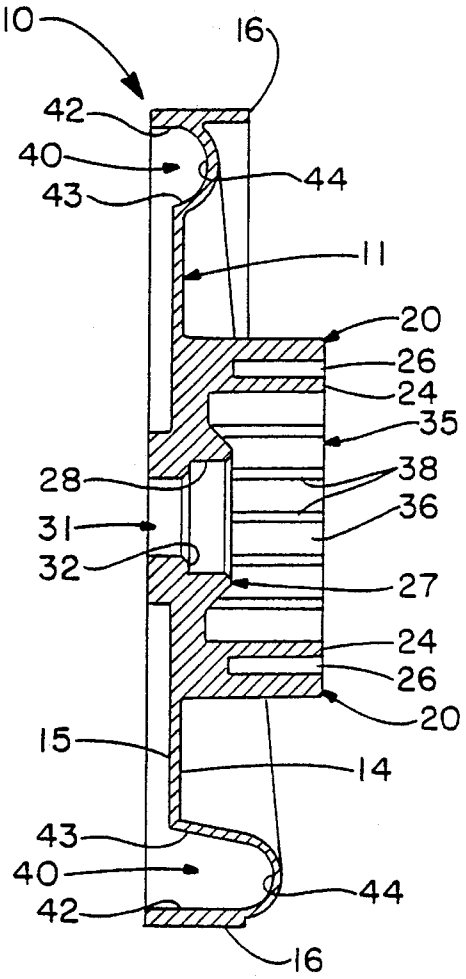
FIG. 3 is a cross-sectional view of the bracket of FIG. 1 taken along the line 3—3.

With reference now to FIGS. 2 and 3, it can be seen that the lower surface of the plate 11 is characterized by a tapered concave scroll passage 40. The passage 40 is defined by the inside surface 42 of the side wall 16 which is opposed by an inside wall surface 43. It is preferred that the radius of the inside wall 43 be roughly three-quarters that of the side wall 16. An inclined rounded upper surface 44 connects the inside wall 43 with the inside surface 42 to define the upper limit of the passage 40. A novel aspect of the passage 40 is its tapered cross-section. It should be noted that when the passage 40 is followed counter-clockwise from point A to point B as designated in FIG. 2, the depth of the passage increases due to the inclined nature of the upper surface 44. This is perhaps best seen in FIGS. 3–8. At point A the passage 40 is at its shallowest, while at point B the passage 40 is at its deepest. It is at point B where the passage 40 joins the exhaust horn 12, communicating therewith by way of an exhaust aperture 46.

The exhaust horn 12 extends tangentially from the plate 11 and essentially serves as an extension of the passage 40. As can be seen the exhaust horn 12 comprises a tapered tubular member 47 having a threaded coupling portion 48. The tubular member 47 defines an enclosed exhaust passage 50 which begins at the exhaust aperture 46 and terminates at the threaded coupling portion 48. The tapered cross-section of the tubular-member 47 results in an exhaust passage 50 which increases roughly 1½ times in diameter from the exhaust aperture 46 to the exhaust outlet 51. That is, the exhaust outlet 51 is roughly 1½ times larger in diameter than the exhaust aperture 46.

The threaded coupling portion 48 of the exhaust horn 12 may include one or more sets of appropriate hose coupling threads 52 such as the standard NHR type. The coupling portion 48 may also include an enlarged diameter coupling seat 54 to prevent overthreading of a hose coupling on the horn 12 and also to serve as a mounting flange for mounting the horn 12 to a housing or the like.

Figure 9:
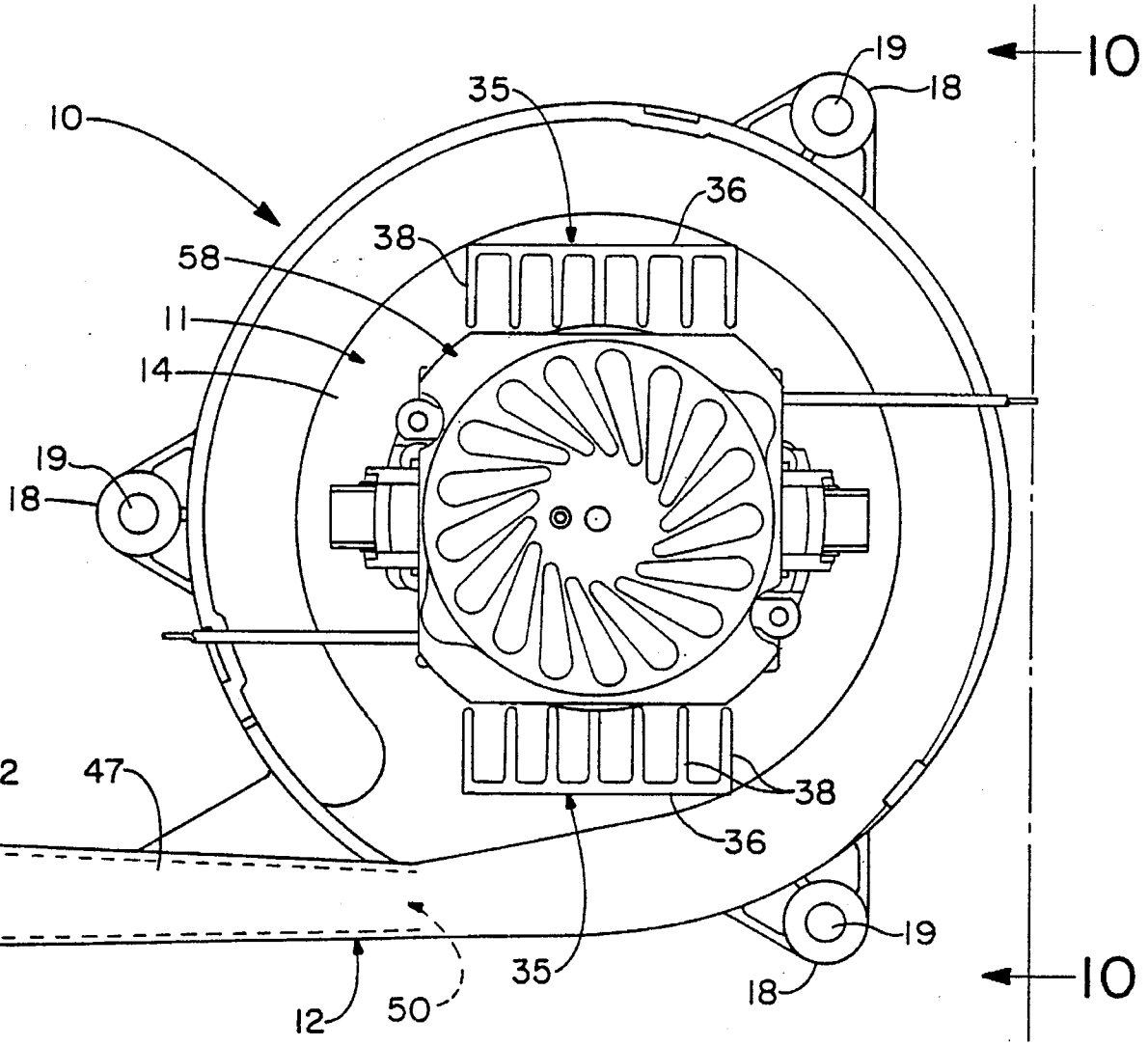
FIG. 9 is a top plan view of a blower fan assembly incorporating the novel end bracket.
Figure 8:
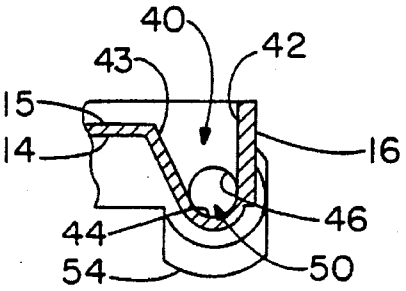
FIG. 8 is a partial cross-sectional view of the bracket of FIG. 2 taken along the line 8—8.
Figure 10:
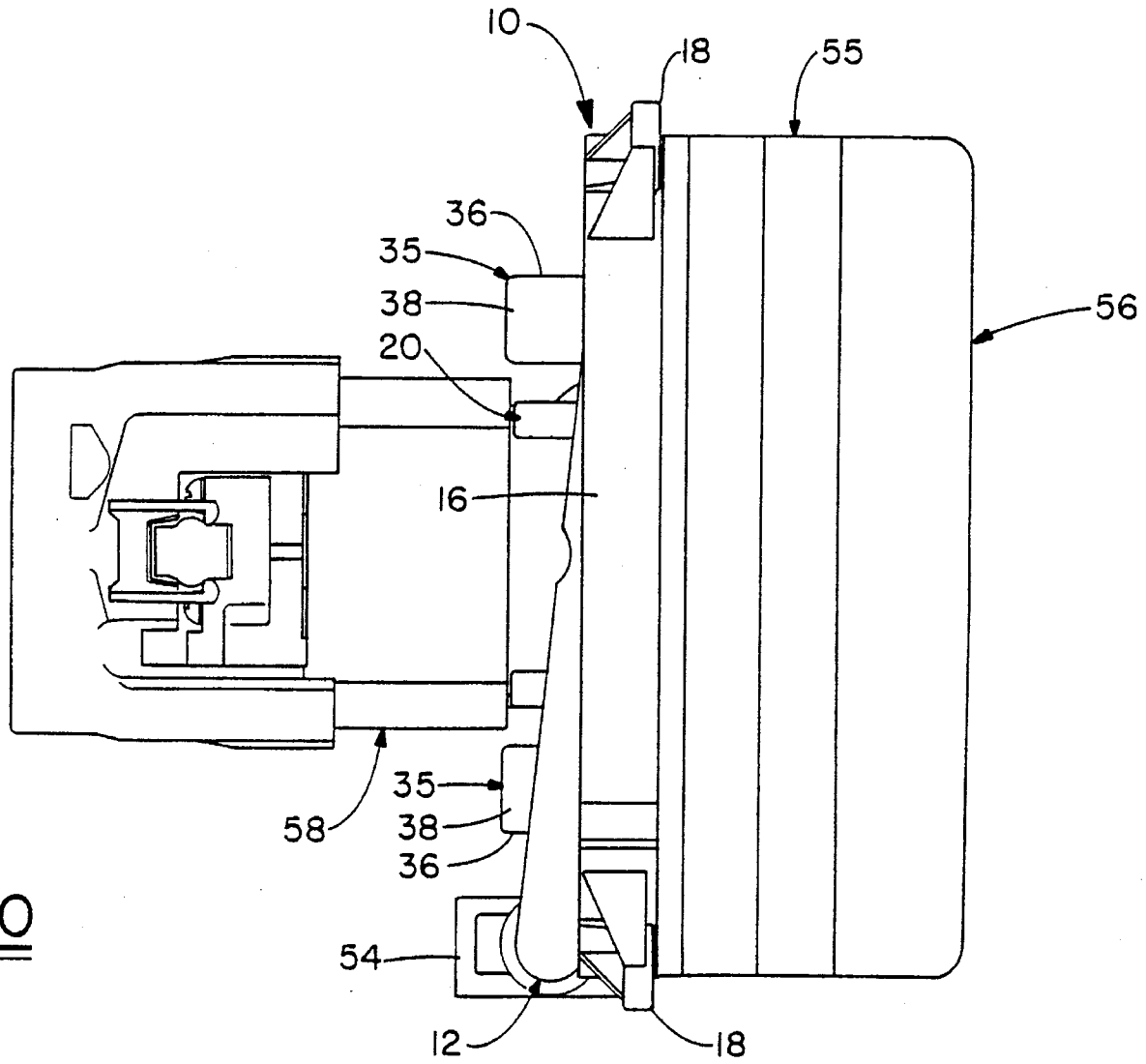
FIG. 10 is an elevational side view of the blower fan assembly of FIG. 9 taken along the line 10—10.

The manner in which the end bracket 10 accomplishes the objects of the invention should now be apparent to those skilled in the art. Specifically, referring to FIGS. 9 and 10, the fan bracket 10 is mounted on a fan housing 55 which includes an intake aperture 56. A fan assembly (not shown) is enclosed in the housing 55. An appropriate motor assembly 58 is similarly mounted to the end bracket 10 by way of the motor mounting brackets 20 and fastener bosses 24. The motor shaft (not shown) is journaled in an appropriate bearing (not shown) which is mounted in the bearing boss 27. The motor shaft extends through the shaft aperture 31 of the plate 11 to engage the fan assembly.

In operation, the motor assembly 58 drives the fan assembly such that a high velocity flow of air is developed from the intake aperture 56 to the end bracket 10. The air enters the scroll passage 40 at point A and is directed through the passage 40 to the exhaust passage 50 of the exhaust horn 12 by way of the exhaust aperture 46.

The heated air expands as it is directed through the scroll passage 40. However, the depth of the passage 40 increases correspondingly so that turbulence produced by the expanding air is alleviated. As the heated high velocity air contacts the end bracket 10 the heat is dissipated from the bearing boss 27 and the end bracket generally, by the vanes 34 of the bearing boss 27 and the vanes 38 of the heat sink members 35. The increased surface area provided by the vanes 34 and 38, as well as the motor mounting brackets 20 facilitates the rapid dissipation of excess heat. Further, heat is directed away from the bearing boss 27 by the vanes 34, some of which directly communicate with the motor mounting brackets 20 and the heat sink members 35, so as to maintain the bearing lubricant at an acceptable temperature and viscosity. Quick, reliable, and secure connection of hoses and the like such as working air hose 60, to the exhaust horn 12 is facilitated by the integrated threaded coupling portion 48, which threadedly mates with the coupling ferrule 62 of the hose 60.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. In a high velocity, low pressure blower assembly having a working air hose, a fan assembly enclosed in a fan housing, the fan housing having an air intake, the fan assembly being drivingly connected to a motor, the improvement comprising:

an end bracket mounted on the fan housing and interposed between the motor and fan housing;

means for dissipating heat incorporated in said end bracket;

means for exhausting air from the fan housing, said means for exhausting incorporated in said end bracket;

means for directing air from the fan assembly to said means for exhausting, said means for directing incorporated in said end bracket;

means for reducing air turbulence in said means for directing, said means for reducing incorporated in said means for directing; and means for connecting said means for exhausting to the working air hose, said means for connecting incorporated in said means for exhausting; and wherein said end bracket comprises an annular plate member, a circumferential wall surrounding said plate member, a central shaft receiving aperture in said plate member, a bearing boss extending from said plate member, and at least one motor mounting standoff extending from said plate member.

2. An improved high velocity, low pressure blower assembly according to claim 1, wherein said means for dissipating heat comprises:

a plurality of vanes radiating from said bearing boss; and at least one heat sink member extending from said plate member, said at least one heat sink member having a plurality of vanes.

3. An improved high velocity, low pressure blower assembly according to claim 1, wherein said means for exhausting air from the fan housing comprises:

a tangential exhaust horn member extending from said circumferential wall; and an exhaust aperture in said circumferential wall, said exhaust aperture communicating with said exhaust horn member.

4. An improved high velocity, low pressure blower assembly according to claim 3, wherein said means for establishing a connection of said means for exhausting to the working air hose comprises:

a plurality of thread members on said tangential exhaust horn; and a coupling seat adjacent to said plurality of thread members.

5. An improved high velocity, low pressure blower assembly according to claim 3, wherein said means for directing air from the fan assembly to said means for exhausting comprises:

a circumferential scroll passage in said plate member, said scroll passage communicating with said exhaust horn member by way of said exhaust aperture.

6. An improved high velocity, low pressure blower assembly according to claim 5, wherein said means for reducing air turbulence in said means for directing comprises:

an inclined surface in said scroll passage, said inclined upper surface defining an upper limit of said scroll passage so that the depth of said scroll passage varies increasingly through the length thereof.

7. A fan end bracket for a high velocity, low pressure blower system, said fan end bracket comprising:

an annular main body plate;

a circumferential wall surrounding said main body plate;

a tapered scroll passage in said main body plate;

a tangential exhaust horn extending outwardly from said main body plate, said exhaust horn communicating with said tapered scroll passage;

a threaded coupling portion on said exhaust horn;

at least one heat sink member extending from said main body plate;

a plurality of vanes extending outwardly from said at least one heat sink member;

at least one motor mounting standoff extending from said main body plate;

a bearing boss extending from said main body plate; and a plurality of vanes radiating outwardly from said bearing boss.

8. A high velocity, low pressure blower assembly, comprising:

a fan housing having an air intake aperture;

at least one fan member mounted in said fan housing;

an end bracket mounted on said fan housing, said end bracket comprising a main body plate having an inner and an outer surface, a circumferential wall surrounding said main body plate, a plurality of fastener lugs extending outwardly from said circumferential wall, a tapered air passage in said inner surface of said main body plate, an exhaust horn extending outwardly from said main body plate and communication with said tapered air passage, a threaded coupling boss on said exhaust horn, at least one heat sink member extending outwardly from said outer surface of said main body plate, a plurality of vanes extending outwardly from said at least one heat sink member, at least one motor mounting standoff extending outwardly from said outer surface of said main body plate, at least one fastener boss in said at least one motor mounting standoff, a bearing boss extending outwardly from said outer surface of said main body plate, said bearing boss comprising a circumferential wall, a plurality of vanes radiating from said circumferential wall, and a shaft aperture;

a bearing mounted in said bearing boss, said bearing having an inner bore and a circumferential outer wall; and a motor mounted on said at least one motor mounting standoff, said motor having a shaft received in said inner bore of said bearing and also received in said shaft aperture of said bearing boss, and operatively connected to said at least one fan member.

* * * * *